United States Patent [19]

Davis, Sr. et al.

[11] 4,350,871

[45] Sep. 21, 1982

[54] HORIZONTAL PASSIVELY COOLED HEATER

[76] Inventors: Raymond K. Davis, Sr., 40 Edgewood Dr.; Marion C. Burns, 111 Heiner Heights, both of Lawrenceburg, Ind. 47025

[21] Appl. No.: 172,164

[22] Filed: Jul. 25, 1980

[51] Int. Cl.[3] ..... H05B 1/00; F24C 7/00

[52] U.S. Cl. ..... 219/343; 219/377; 219/347

[58] Field of Search ..... 219/343, 347, 375, 367, 219/377, 342

[56] References Cited

U.S. PATENT DOCUMENTS

| | | | |
|---|---|---|---|
| 1,494,654 | 5/1924 | Weir | 219/347 |
| 1,518,067 | 12/1924 | Hicks | 219/377 |
| 2,051,456 | 8/1936 | Muir et al. | 219/347 |
| 2,455,967 | 12/1948 | Adams | 219/342 |
| 2,537,821 | 1/1951 | Fodor | 219/367 |
| 2,551,319 | 5/1951 | Eiklid | 250/495 |
| 2,944,138 | 7/1960 | Goff | 219/367 |
| 2,995,644 | 8/1961 | Zellers | 219/473 |
| 3,217,139 | 11/1965 | Barber | 219/347 |
| 3,221,139 | 11/1965 | Orr | 219/345 |
| 3,564,201 | 2/1971 | Jones et al. | 219/367 |
| 3,691,345 | 9/1972 | Needham et al. | 219/345 |

FOREIGN PATENT DOCUMENTS

| | | | |
|---|---|---|---|
| 988137 | 8/1951 | France | 219/377 |
| 2046668 | 5/1971 | France | 219/343 |
| 739388 | 10/1955 | United Kingdom | 219/377 |
| 1410529 | 10/1975 | United Kingdom | 219/367 |

*Primary Examiner*—Bernard Roskoski

*Attorney, Agent, or Firm*—Wood, Herron & Evans

[57] ABSTRACT

A quartz heater, an elongated, rectilinear heating element which lies in a horizontal position in front of a reflector in an improved housing designed to enable the outer surface of the housing to remain cool during operation without the aid of an active cooling system such as a fan or water cooling system. This is accomplished by drawing cooling air from beneath the heater to bathe both front and rear surfaces of the reflector and further preventing air in the front of the heater from being drawn into the heater. The cooling air upon entering the interior of the housing is divided into two flow paths, one of which exhausts at approximately a 45° angle toward the front of the heater and the second exhausts directly from the top of the heater.

9 Claims, 5 Drawing Figures

HORIZONTAL PASSIVELY COOLED HEATER

This invention relates to a heater and, more particularly, the invention relates to a heater having a horizontally oriented quartz tube as the heating element.

It is well known in the prior art to make portable electric space heaters which utilize resistance heating elements. It is also known to use quartz tubes as a source of infrared radiation to heat objects. However, due to the extreme heat generated using a quartz tube heating element, portable heaters have generally not incorporated the quartz tube as a heat source. This is the case despite the fact that quartz tube heating elements have several advantages over the commonly used resistance heating elements.

A quartz tube heating element heats by generating rays of infrared radiation which warm radiated objects. Heating by means of infrared radiation enables an object positioned relatively far away from the heater to be warmed using a 1000 watt quartz heating element. However, if a resistance type heater drawing the same amount of energy were used, the object would have to be substantially closer to the heater to feel the generated heat. The reason for this is that resistance heaters operate by heating the surrounding air and thus, heat must be transferred to persons by convection, that is, by first heating the air surrounding the heater and relying on convection currents to carry that heat to the person. In addition, the heated air tends to rise away from the object to be heated.

When heating by means of infrared radiation, the energy is transmitted directly to the person in the form of radiant energy. The radiant energy is converted into perceptible heat upon striking an object which absorbs the particular wavelength of the radiant energy. The air which absorbs little or no infrared rays is not heated. The energy which is intended to heat an object is not wasted heating the air between the object and the heater. In addition, infrared rays, although diffusing, can be directed by using a reflector. Thus, an object can be heated quickly at a greater distance from the heater without requiring a great deal of energy.

Even with these obvious advantages over resistance-type heaters, portable quartz heaters have not penetrated the market except to a limited extent. Wall or ceiling mounted heaters are known and available. However, the heat generated by the quartz tube, 900°–1000° F. at the surface of a 1000 watt quartz, causes the tube housing of the heater to rise to an impractically and dangerously high temperature.

SUMMARY OF THE INVENTION

With the foregoing in mind, it is the object of this invention to provide a quartz heater which is designed in such a manner as to keep the housing of the heater cool without the aid of a fan or other active cooling means.

Another object of the invention is to provide a heater with an extremely hot heating element which is safe enough to use as a portable heater.

It is a further object of this invention to provide such a heater which is simple and inexpensive to construct.

These and other objectives have been attained by designing a heater whose housing substantially improves the air flow between the heating element and the housing. This has been accomplished by a design utilizing a series of elements which in combination produce a synergistic result. Specifically, the cooling air is drawn from the bottom, rear, and sides of the heater into the housing. As it flows between the reflector and the housing, it is channeled into two streams, each of which exits the housing separately. One stream flows out of the housing through openings located in the top of the housing; and the second stream exits through openings located in a beveled portion of the upper front portion of the housing. Further, the housing has other structural relationships which have been found empirically, to materially affect its operation. These will be described below and it will be noted that substantial variations from any of them will result in sharp rises in temperature. Thus, the invention resides in the described structural organization of the housing in combination with the horizontal tube and reflector configuration. The housing and reflector elements, through convection, force cooling air to flow around the quartz tube and the reflector and supporting housing elements to maintain the housing reasonably and safely cool.

Figure 1:
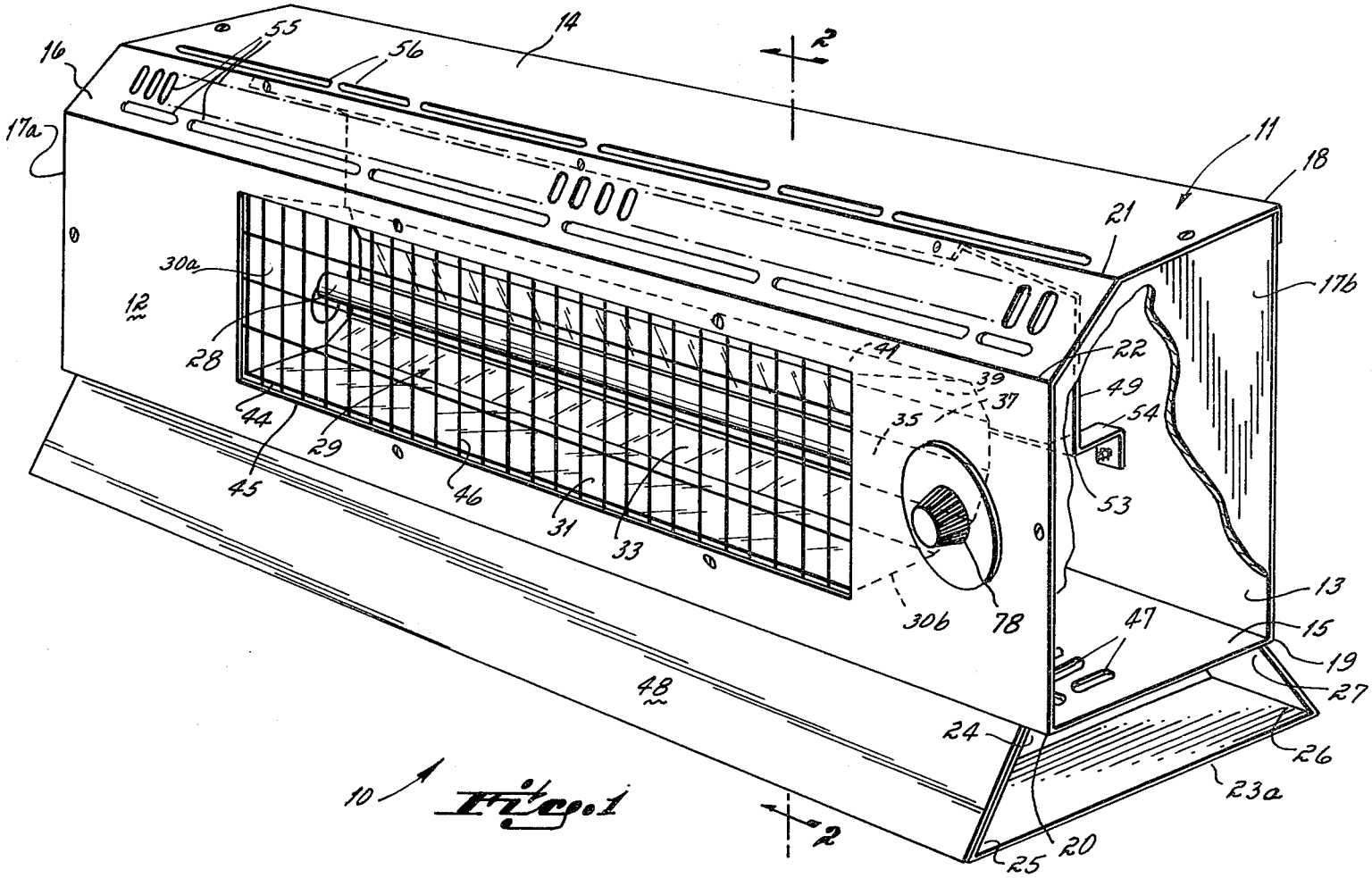
FIG. 1 is a perspective view of the invention with the lower right corner of the heater cut away.

The heater of this invention is indicated at 10 and includes a housing 11 having a front wall 12, a rear wall 13, a top wall 14, a bottom wall 15, an angled wall 16 located between and connecting the front wall 12 and the top wall 14, and two mirrow image side walls **17*a* and 17*b***.

All walls, except the two side walls, have substantially the same horizontal length. As seen in FIG. 1, front wall 12 and rear wall 13 are parallel to each other and perpendicular to the plane of the ground. The rear wall 13 extends somewhat vertically higher than the front wall 12. Bottom wall 15 and top wall 14 are parallel to each other and parallel to the plane of the ground. Both top and bottom walls are rigidly attached to the rear wall 13 at right angles at junctures 18 and 19, respectively, and bottom wall 15, which is somewhat wider than top wall 14, extends from juncture 19 to front wall 12 and is rigidly connected to the front wall at juncture 20. Angled wall 16 lies between and is rigidly connected to both top wall 14 and front wall 12 at junctures 21 and 22, respectively, and rises at a 45° angle from the front wall to the top wall. This generally rectangular housing is mounted on a plurality of legs which act to support the heater, keep it away from the floor, and permit airflow beneath the heater, a function whose significance will become apparent.

Figure 2:
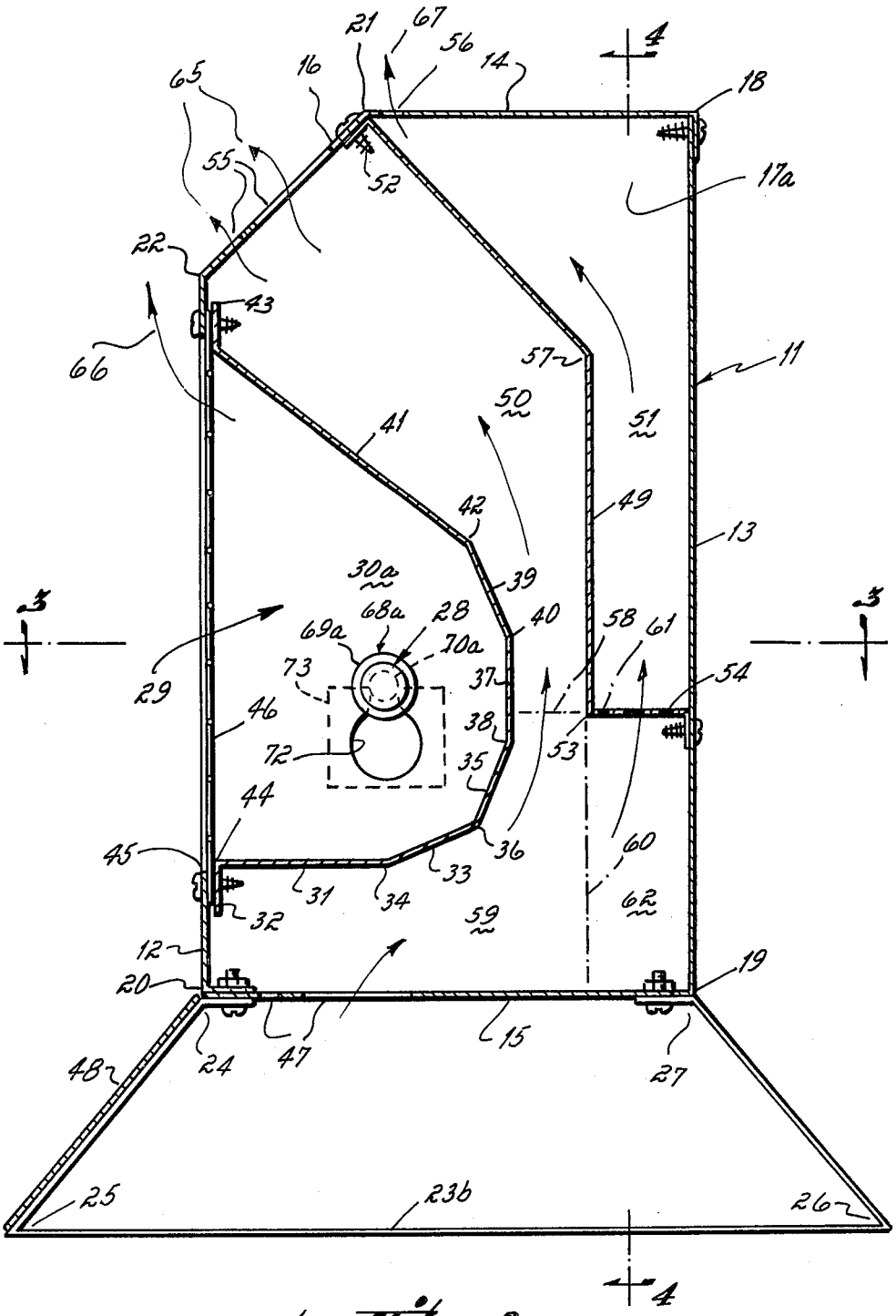
FIG. 2 is a cross-sectional view taken at lines 2—2 of FIG. 1.
Figure 4:
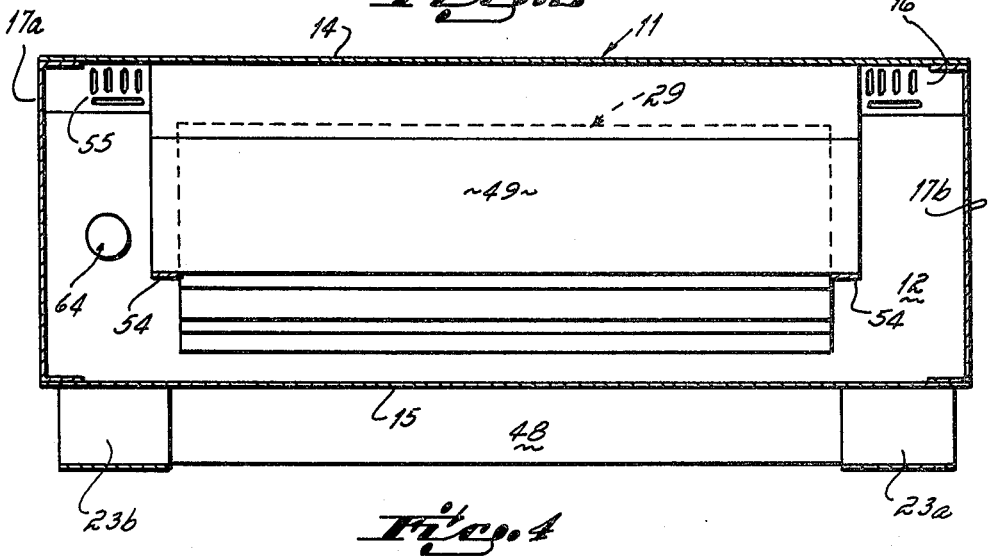
FIG. 4 is a cross-sectional view taken at lines 4—4 of FIG. 2.

As can best be seen in FIGS. 2 and 4, these legs **23*a* and 23*b* are preferably two in number. Both legs are substantially identical, and only leg 23*b* will be described. Leg 23*b* is rigidly connected to the anterior portion of the heater, preferably at juncture 24 which coincides with a portion of juncture 20. The leg extends from juncture 24 downwardly until it is directed rearwardly at a bend 25. From bend 25, the leg extends parallel to the plane of the ground to a second bend 26. From this second bend, the leg extends upwardly to a juncture 27** which coincides with a portion of juncture 19 where the leg is rigidly conjoined to the housing of the heater.

The heater preferably includes a quartz tube heating element 28 which is mounted in front of and adjacent to a reflector 29. The reflector, as shown in FIG. 2, which is drawn substantially to scale, is a horizontally elongated segmented reflector, i.e., one comprising a series of flat panels connected at various angles and designed to reflect radiation over a specific area as opposed to, for example, a parabolic reflector which reflects the radiation within the confines of a parabola. However, with a segmented reflector, the radiation can be reflected upwardly, and not downwardly. Thus, radiation is not directed toward the floor where it would be wasted. The reflector, as shown in FIG. 2, which is the preferred reflector, includes two mirror image side panels 30*a* and 30*b*, and six panels running between and connected to each side panel. These panels make up the reflecting surface of the reflector 29. The first of these panels 31 is located at the bottom of the reflector and lies parallel to the plane of the earth. One edge of panel 31 ends in a flange 32 used to connect the reflector to the housing. The opposite edge of this first panel is connected to a second panel 33 at a seam 34. The angle between these two panels is approximately 143°. The side of panel 33 opposite seam 34 is connected to a third panel 35 at a second seam 36. The angle between second panel 33 and third panel 35 is approximately 154°. The side of third panel 35 opposite second seam 36 is connected to a fourth panel 37 at a third seam 38. The angle between this third panel and the fourth panel is approximately 152°. This fourth panel is approximately perpendicular to the plane of the earth. The side of fourth panel 37 opposite the third seam 38 is connected to a fifth panel 39 at a fourth seam 40. The angle between the fourth panel and the fifth panel is approximately 153°. The edge of the fifth panel opposite the fourth seam 40 is connected to a sixth panel 41 at a fifth seam 42. The angle between the fifth panel and the sixth panel is approximately 154°. The edge of the sixth panel opposite the fifth seam is connected to a second flange 43. The edges of the first and sixth panels and the two side members of the reflector define an opening 44 of the reflector 29. Preferably, as is shown in FIG. 2, the sixth panel is the widest panel and gradually extends from the fifth panel across to the front wall 12.

As will be described below, the shape of this reflector was designed to optimally reflect infrared rays and, in addition, aids in the cooling of the heater housing.

The reflector is connected to the front wall 12 of the heater housing 11. Front wall 12 has an opening 45 which is aligned with the opening 44 of the reflector. Between the front wall of the heater and the reflector is a grill 46. This grill is preferably a wire screen and acts to separate first and second flanges 32 and 43 of the reflector 29 from the front wall 12, thus decreasing the heat flow by conduction from the reflector to the housing. The opening 45 in the front wall 12 of the heater is preferably slightly larger than the opening 44 of the reflector. This prevents infrared radiation from striking the housing and causing it to heat up.

The quartz tube heating element 28 is supported by the side walls 30*a* and 30*b* of the reflector. Preferably, the opposite ends of the quartz tube are capped by vitreous non-conducting mounting caps 68*a* and 68*b* which each comprise a major inner section 69*a* and 69*b* and a minor or smaller hollow tube-shaped outer section 70*a* and 70*b*. These outer sections are hollow to permit the electrical wires to pass through to the quartz tube. The inner sections 69*a* and 69*b* encase each end of the quartz tube. The outer tube sections 70*a* and 70*b* project through a minor and a major hole 71 and 72, respectively, located in either side of the reflector and are thereby supported by the side walls on the edges of these holes. The major hole 72 is large enough to allow the entire tube to pass into the reflector to assemble the heater. Once the tube is in place, i.e., when tube section 70*b* is inserted in hole 71 and tube section 70*a* is positioned in major hole 72, a plate 73 is placed over part of the major hole 72 to reduce its size and prevent the quartz tube from sliding out of position. Preferably, both the minor hole and the major hole as reduced by the plate 73 should be slightly larger than the minor tube sections 70*a* and 70*b* to allow for thermal expansion and contraction of the tube.

An air intake, which is a row or rows of holes 47, passes through the bottom wall 15. The air intake extends substantially from one end of said wall to the other. Preferably, these intake holes are located in the front portion of wall 15 beneath reflector 29.

A novel improvement of this invention is the positioning of a front plate or barrier 48 in the lower front of the heater beneath said front wall, substantially blocking the flow of air from the front of the heater into the intake. As shown in FIG. 1, this barrier extends from one side of the heater to the other and from the lowest portion of the legs 23 of the heater (coinciding with angle 25) to the bottom of the front wall 12, i.e., the juncture 20 where the front wall and the bottom wall join. The barrier blocks the flow of air through the area between the legs at the front of the heater. It was found during the study leading to this invention that without this barrier 48, the housing grew quite hot during operation. The barrier apparently causes a greater quantity of air to flow up the back surface of the reflector 29. By using this barrier, a substantial drop in housing temperature was noticed.

An improvement which is also critical to the operation of this invention is the use of a divider panel 49 positioned between the rear wall 13 and the reflector 29 acting to divide the interior of the housing into a front flow chamber 50 and a rear flow chamber 51. Divider panel 49 is rigidly connected to the housing at the juncture 21 of the top and angled panels by means such as screws 52. This panel extends from juncture 21 to a line 53 approximately midway between the reflector and the rear panel slightly below the level of the quartz tube 28 (see FIG. 2). Preferably, the bottom edge of the divider panel is supported from the rear panel by a plurality of spaced tabs 54. Tabs 54 must be strong enough to give support and should be spaced apart sufficiently to permit the upward flow of rising, cooling air between them.

Figure 3:
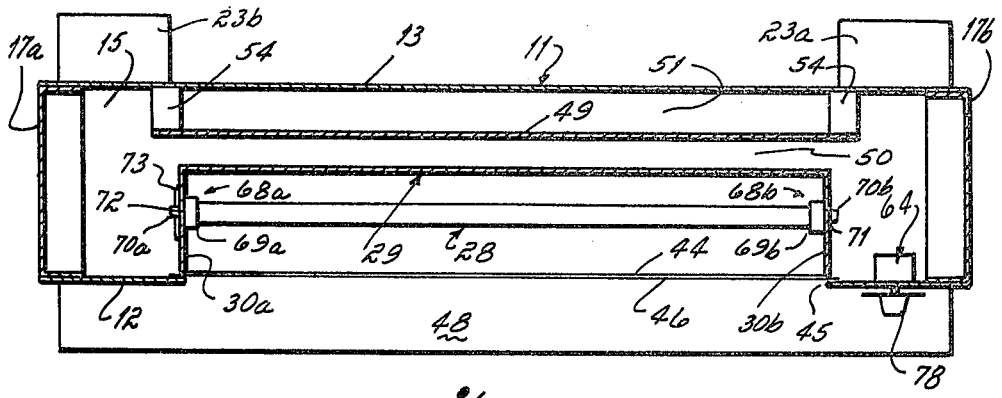
FIG. 3 is a cross-sectional view taken at lines 3—3 of FIG. 2.

It was found that the cooling effect caused by this dividing panel 49 was most effective when its length was at least as long as the reflector 29, but shorter than the total length of the housing as shown in FIG. 3. Preferably, the divider panel should extend one inch beyond either end walls 30(*a*) and 30(*b*) of the reflector 29.

The upper section of the front flow chamber 50 is bordered by angled wall 16 which contains a first exhaust 55. Like intake 47, first exhaust 55 is a series of holes through wall 16 extending substantially across the length of the angled wall.

The upper section of the rear flow chamber 51 is bordered by top wall 14 which contains a second exhaust 56 which is a series of holes through the top wall extending substantially across the length of the panel. Preferably, the total area of the holes making up the two exhausts should be greater than the total area of the holes of the intake.

The size of each flow chamber increases near the respective exhausts. In the preferred embodiment, the increase in the size of the rear flow chamber is accomplished by bending the divider plate at bend 57 so that the portion below this bend is perpendicular to the plane of the ground and the portion above this bend slants toward the front of the heater. The volume of the upper section of the front flow chamber increases due to a decrease in the cross-section dimension of the reflector as it nears the point 21 at which it connects to the front wall. It is believed that this increase in the volume of the flow chambers as they near their respective exhausts improves the airflow by minimizing internal resistance.

In order to maximize the cooling effect of this housing, it is preferable to design the reflector and the divider panel in such a manner as to minimize the eddy-currents in the air as the air flows through the housing. In part, this is accomplished by making the reflector an efficient air foil. That is, the cross-sectional area decreases slowly toward the top by making the slope of panel 41 less acute. If the segmented reflector is changed, it may be desirable to change the shape of the divider panel. As can be seen in FIG. 2, the divider panel 49 is bent at 57. It is preferable to position this bend in a manner so as to minimize the eddy-currents within the housing plate. These eddy-currents can easily be observed by replacing one of the side panels with a transparent panel and passing smoke through the housing while the heater is operating. Minor changes in the shape of the divider panel 49, such as varying the angle at 57, can then be made to minimize the eddy-currents produced.

A final consideration in positioning the baffle panel 49 is the relative areas of the front and rear flow chambers as compared to the area directly beneath these flow chambers. For purposes of the following description, these areas represent only that portion of the interior of the housing located between the sides of the reflector. The area of the front flow chamber 50 is defined by the angled wall 16 on top, the divider panel 49 in the rear, the posterior side of the reflector in the front, and a first imaginary plane 58 (see FIG. 2) extending from the bottom edge 53 of the divider panel 49 to the reflector, said imaginary plane being parallel to the bottom wall 15. A first intake section 59 is also defined as the area within the housing immediately below this front flow chamber and bordered on one side by a second imaginary plane 60 which extends from the bottom 53 of the divider panel to the bottom wall 15. For optimum cooling, the ratio of the volume of the front flow chamber 50 to this first intake section 59 should be approximately 5 to 3, respectively.

The rear flow chamber 51 is defined on top by the top wall 14, on the back by said rear wall 13, on the front by the divider panel 49, and on the bottom by a third imaginary plane 61 extending from the bottom edge 53 of divider panel to the rear wall, said imaginary plane being parallel to the bottom wall and partially coinciding with the tabs 54. A second intake section 62 is also defined as the area within the heater housing which is immediately below the third imaginary plane and bordered on one side by the rear wall and on the front side by the second imaginary plane 60. The relative volume of the rear flow chamber 51 to the second intake section 62 should be approximately 4 to 1, respectively.

The electrical current is supplied to the quartz tube through current conducting wires 63 connected to either ends of the tube. These wires can be connected in series to an activation or regulating switch 64 as desired.

Preferably, the switch is an adjustable bimetal switch which contains a small resistance heating element near a bimetallic contact. A switch such as this reponds to the amount of current passing through the quartz tube. Specifically, current passes through the resistance heating element of the switch which heats the bimetal and causes it to bend. When the bimetallic contact is sufficiently hot, it bends out of contact, discontinuing current flow through the quartz tube. This is preferable because the quartz tube produces infrared radiation upon being heated by current passing through a heating element within the tube. The tube continues to generate radiation until it cools. A bimetal switch with an internal heating element periodically cuts off current to the quartz tube. However, the quartz tube continues to generate radiation until it cools. Thus, the quartz tube continues to generate radiation without using additional energy. After the tube cools, radiation is no longer produced. However, the bimetal also cools and returns to the contact position providing current to the tube again.

Figure 5:
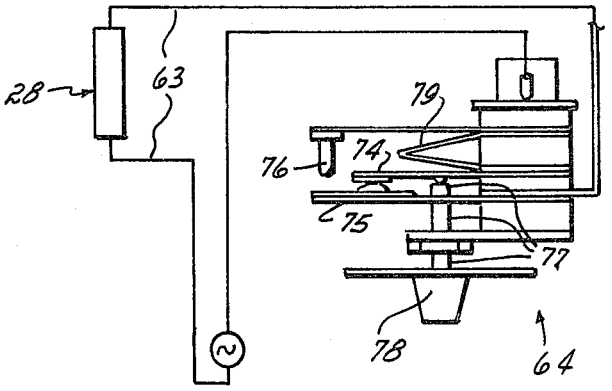
FIG. 5 is a plan view of the heater switch.

As shown in FIG. 5, a bimetallic contact member 74 is in contact with a second contact member 75 which is tensioned forwardly toward a stop element 76. The switch adjusts by means of a rod 77 which screws forwardly by turning a dial 78 and pushes the bimetal forwardly away from the second contact member. Since the second contact member is biased forwardly, contact is maintained until the bimetal moves beyond the stop member 76, thus breaking contact. This can be accomplished by either turning the dial until rod 77 pushes the contact member beyond this point or by the bimetal contact bending beyond this non-contacting point. The bending is caused by heating the bimetal contact and specifically the heat is generated by a resistance heating ribbon 79 made of steel or nichrome wired in series with contacts 74. Thus, as current flows between the contacts, it also flows through the heater ribbon 79 and causing heat to be generated. This heat causes the bimetal contact to bend forwardly and eventually out of contact with the second contact member. Thus, the current to the quartz tube and the resistance heating element is cut off. As the bimetal cools, it bends rearwardly until it contacts the second contact member and the quartz tube is once again energized.

In operation, electrical current is passed through quartz tube 28 causing the quartz to vibrate, thus generating infrared radiation. The heat generated by the heating element, which is not radiated through the reflector opening, is transferred through the reflector and heats the air behind the reflector and the air within the housing. Since hotter air rises, the air within the heater will rise. Cooling air is drawn from beneath the heater through intake holes 47 and rises between the reflector and the housing. Barrier 48 prevents the air from being drawn from the front of the heater. As the air rises, it is divided between two flow chambers 50 and 51 by divider panel 49. The air flowing in the front chamber 50 exits through exhaust holes 55 located in angled wall 16.

This angled exit allows the air which is coming out of the front exhaust depicted by arrows 65 to mix with an upwardly flowing internal airstream depicted by arrow 66 which is created as the air around the quartz tube is heated and rises along the reflector surface and up the front of the heater. This external airstream is believed to mix with the air from the front flow chamber as it exits through the exhaust in the angled wall, creating a venturi effect and drawing more cooling air through the front chamber. The air in the rear flow chamber 51 is also heated and, therefore, rises. This air exits through exhaust holes 56 as depicted by arrow 67. This flow of air draws heat off the heater housing, keeping the housing cool and safe enough to position on a rug or other potentially flammable material.

Having generally described the design and operation of this heater, it will be apparent to one of ordinary skill in the art to make various minor changes without departing from the scope of this invention.

Thus, having described the preferred embodiment of the invention, what is claimed is:

1. A heater comprising an elongated generally rectangular horizontal housing having front, back, top, and bottom walls and an angled wall extending from said front wall upwardly to said top wall connecting said front and top wall;

an opening in said front wall;

a reflector positioned within said housing in alignment with said opening in said front wall; a horizontal heating element positioned in front of said reflector; a first series of exhaust openings within said angled wall; a second series of exhaust openings within said top wall; a divider panel located between said first series of openings and said second series of openings; creating a front flow chamber and a rear flow chamber; said first series of openings opening into said front chamber and said rear series of openings opening into said rear chamber; a series of intake openings within said bottom panel; a barrier panel extending below said bottom wall, said barrier panel being located forwardly of said series of intake holes; and said barrier panel substantially preventing air from being drawn from beneath said bottom panel forwardly of said heater.

2. A heater as defined in claim 1 wherein said heating element is a horizontal quartz tube heating element.

3. A heater as defined in claim 2 wherein said divider panel is longer than said reflector and shorter than said housing.

4. A heater comprising an elongated generally rectangular horizontal housing having front, top, bottom and rear walls and an angled wall extending upwardly from said front wall and connecting said front and said top walls;

an opening in said front wall;

a reflector mounted within said housing in alignment with said opening in said front wall;

a horizontal elongated quartz heating element mounted in front of said reflector;

a divider panel mounted between said front and said rear walls creating a front and a rear flow chamber;

a first series of exhaust openings in said angled wall located forwardly of said divider panel; and opening into said front flow chamber; a second series of exhaust openings in said top wall located rearwardly of said divider panel and opening into said rear flow chamber; a series of intake openings located in said bottom panel, wherein the total combined area of said first and said second series of exhaust openings is greater than the area of the intake openings; a barrier panel extending downwardly below said bottom panel positioned in front of said intake openings; and said barrier panel substantially preventing air from being drawn from beneath said bottom panel forwardly of said heater.

5. A heater comprising an elongated generally rectangular horizontal housing having front, top, bottom, and rear walls and an angled wall extending upwardly from said front wall and connecting said front and said top walls;

a segmented reflector mounted within said housing in alignment with said opening and said front wall, a horizontal elongated quartz heating element mounted forwardly of said segmented reflector; a divider panel mounted between said front and said rear walls creating front and rear flow chambers; a first series of exhaust openings located in said angled wall forwardly of said divider panel; and opening into said front flow chamber; a second series of exhaust openings in said top wall rearwardly of said divider panel; and opening into said rear flow panel; a first series of intake openings located in said bottom panel; a barrier panel extending downwardly below said bottom panel and positioned forwardly of said openings in said bottom wall;

wherein said barrier panel substantially prevents air from being drawn from beneath said bottom panel forwardly of said heater.

6. A heater as defined in claim 5 wherein said segmented reflector includes a bottom panel, said bottom panel being positioned parallel to the plane of the earth.

7. A heater comprising an elongated generally rectangular housing having front, top, bottom and rear walls and an angled wall extending upwardly from said front wall and connecting said front wall and said top wall; an opening in said front wall; a reflector mounted within said housing in alignment with said opening in said front wall; a horizontal elongated quartz heating element mounted in front of said reflector; a first series of exhaust openings in said angled wall; a second series of exhaust openings in said top wall; a divider panel having a bottom edge, said divider panel extending from a position between said first and said second series of exhaust openings; and being mounted between said front and back walls defining front and rear flow chambers, said front flow chamber being defined as the area within the housing directly behind the reflector and above the bottom edge of the divider panel and forward of said divider panel and said rear flow chamber being defined as the area within the housing directly behind the reflector and the divider panel and above the bottom edge of the divider panel, and wherein the area within the housing beneath the front flow chamber is defined as the first intake section and wherein the area within the housing below the rear flow chamber is defined as the second intake chamber and wherein the ratio of the volumes of the front flow chamber to the first intake section is five to three, respectively, and the ratio of the volume of the rear flow chamber to the second intake section is four to one, respectively;

a first series of intake openings in said bottom wall;

a barrier panel extending downwardly below said bottom panel positioned forwardly of said openings in said bottom panel.

8. A heater comprising an elongated generally rectangular horizontal housing having front, top, bottom and rear walls and an angled wall extending upwardly from said front wall connecting said front and said top walls;

an opening in said front wall;

a segmented reflector mounted within said housing in alignment with said opening in said front wall, said reflector being mounted to said front wall;

a wire grill positioned between said front wall and said reflector;

a horizontal elongated quartz heating element mounted in front of said reflector;

a divider panel having a top edge and a bottom edge, said panel being mounted between said reflector and said rear wall creating front and rear flow chambers wherein the horizontal cross-section of said front and said rear flow chambers is larger near the top edge than near the bottom edge of said divider panel and wherein said divider panel is longer than said reflector and shorter than said heater housing;

a first series of exhaust openings in said angled wall forward of said divider panel; and opening into said front flow chamber;

a second series of exhaust openings in said top wall rearward of said divider panel; and opening into said front flow chamber;

openings in said bottom wall;

a barrier panel connected to said housing extending downwardly below said bottom panel in front of said intake openings;

said barrier panel substantially preventing air from being drawn from beneath said bottom panel forwardly of said heater.

9. A heater adapted to be supported from a generally planar surface comprising an elongated, generally rectangular horizontal housing having front, back, top and bottom walls and an angled wall extending from said front wall upwardly to said top wall connecting said front wall and said top wall;

means to maintain said bottom wall above said generally planar surface;

an opening in said front wall;

a reflector positioned within said housing in alignment with said opening and said front wall;

a horizontal heating element positioned in front of said reflector;

a first series of exhaust openings within said angled wall;

a second series of exhaust openings within said top wall;

a divider panel located between said first series of openings and said second series of openings; creating a front flow chamber and a rear flow chamber, said first series of openings opening into said front flow chamber and said second series of openings opening into said rear flow chamber;

a series of intake openings within said bottom panel;

a barrier panel extending below said bottom wall approximately to said generally planar surface, said barrier panel being located forwardly of said series of intake holes; and whereby said barrier panel prevents air from being drawn from beneath said bottom panel forwardly of said heater.

* * * * *

UNITED STATES PATENT AND TRADEMARK OFFICE

CERTIFICATE OF CORRECTION

PATENT NO. : 4,350,871

DATED : September 21, 1982

INVENTOR(S) : Raymond K. Davis and Marion C. Burns

It is certified that error appears in the above-identified patent and that said Letters Patent is hereby corrected as shown below:

In column 2, line 36, change "mirrow" to --mirror--.

In column 4, line 39, the following sentence should be added. After "29.", add --The barrier substantially prevents air from being drawn from beneath said bottom panel forwardly of said heater and along the forward surface of the reflector.--.

In column 7, line 3, change "internal" to --external--.

Signed and Sealed this

*Twelfth* Day of *July 1983*

[SEAL]

*Attest:*

GERALD J. MOSSINGHOFF

*Attesting Officer*

*Commissioner of Patents and Trademarks*